United States Patent [19]

Morris

[11] Patent Number: 4,929,969

[45] Date of Patent: May 29, 1990

[54] INK SUPPLY CONSTRUCTION AND PRINTING METHOD FOR DROP-ON-DEMAND INK JET PRINTING

[75] Inventor: Brian G. Morris, Dayton, Ohio

[73] Assignee: Eastman Kodak Company, Rochester, N.Y.

[21] Appl. No.: 398,580

[22] Filed: Aug. 25, 1989

[51] Int. Cl.[5] ..... B41J 2/175

[52] U.S. Cl. ..... 346/140 R; 222/187; 521/52; 346/1.1

[58] Field of Search ..... 346/140, 1.1; 401/198, 401/199; 222/187, 189; 521/52

[56] References Cited

U.S. PATENT DOCUMENTS

| | | | |
|---|---|---|---|
| 3,160,596 | 12/1964 | Spencer | 260/2.5 |
| 3,967,286 | 6/1976 | Andersson et al. | 346/140 |
| 4,007,142 | 2/1977 | Clarke et al. | 260/2.5 |
| 4,095,237 | 6/1978 | Amberntsson et al. | 346/140 |
| 4,179,027 | 8/1978 | Weisberg | 222/187 X |
| 4,192,923 | 3/1980 | Lajkowski | 521/117 |
| 4,329,698 | 5/1982 | Smith | 346/140 |
| 4,334,971 | 6/1982 | Mahnke et al. | 204/159 |
| 4,367,294 | 1/1983 | Hahn et al. | 521/158 |
| 4,368,478 | 1/1983 | Koto | 346/140 |
| 4,406,816 | 9/1983 | Sliwka | 521/69 |
| 4,509,062 | 4/1985 | Low et al. | 346/140 |
| 4,511,678 | 4/1985 | Mahnke et al. | 521/52 |
| 4,522,878 | 6/1985 | Martin et al. | 428/313 |
| 4,530,940 | 7/1985 | Woerner et al. | 521/124 |
| 4,630,758 | 12/1986 | Mutoh | 222/189 |
| 4,666,948 | 5/1987 | Woerner et al. | 521/105 |
| 4,771,295 | 9/1988 | Baker et al. | 346/1.1 |
| 4,794,409 | 12/1988 | Cowger et al. | 346/140 |

*Primary Examiner*—Joseph W. Hartary
*Attorney, Agent, or Firm*—John D. Husser

[57] ABSTRACT

A process and apparatus for drop-on-demand ink jet printing utilize the steps of: selectively ejecting ink drops from drop ejection regions through related orifices; feeding ink through capillary feed passages to the drop ejection regions to replace ejected ink drops; and supplying ink to said capillary passages from an innately reticulate foam structure comprising a network of fine, mutually-connected, three-dimensionally branched filaments.

36 Claims, 4 Drawing Sheets

FIG. 1
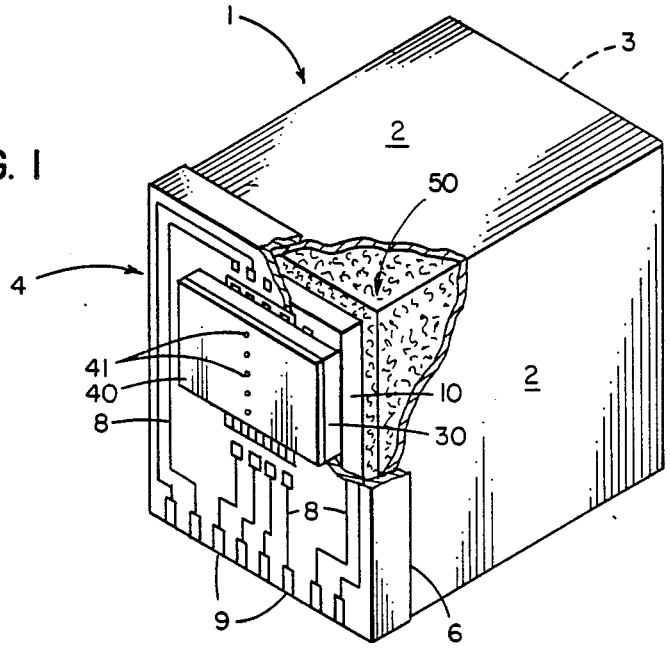
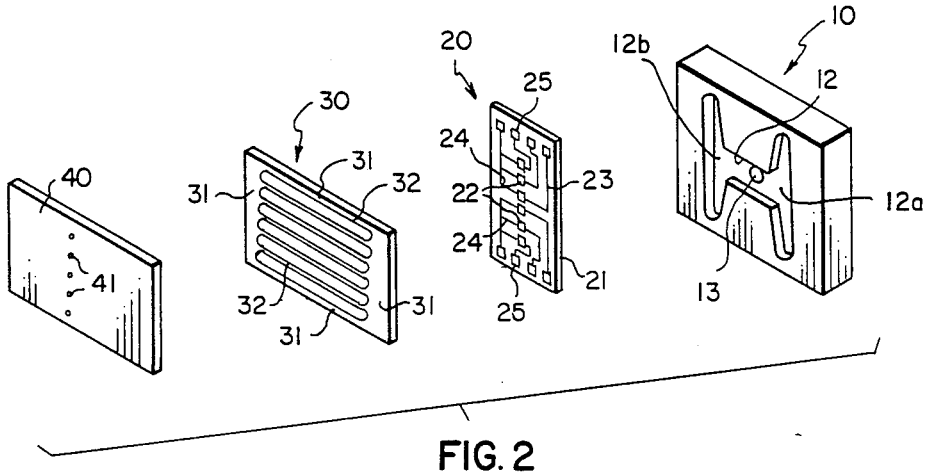
FIG. 2

FIG. 5
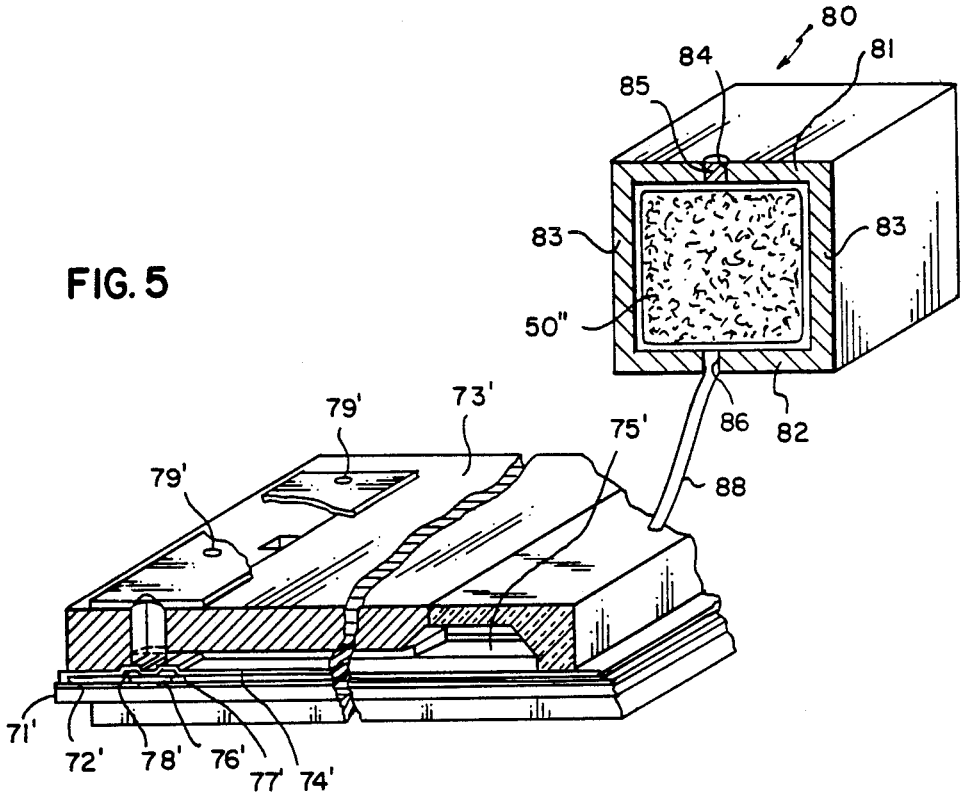
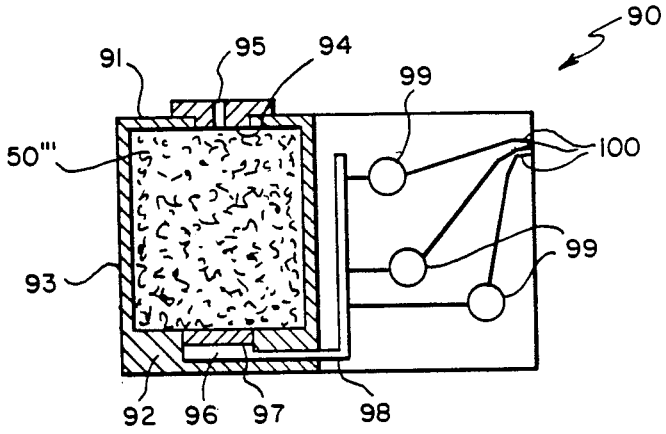
FIG. 6

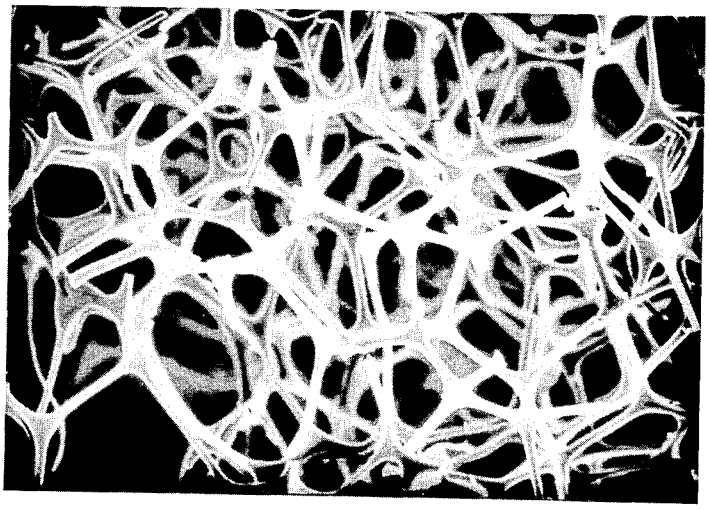
FIG. 7
FIG. 8 (PRIOR ART)
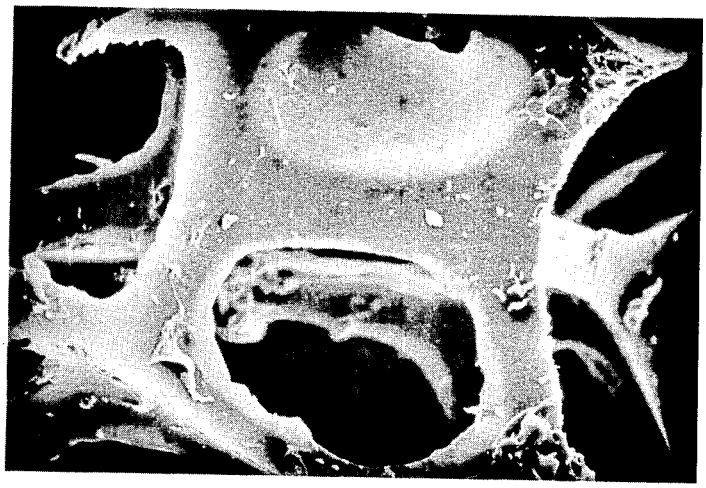

INK SUPPLY CONSTRUCTION AND PRINTING METHOD FOR DROP-ON-DEMAND INK JET PRINTING

FIELD OF INVENTION

The present invention relates to ink jet printing devices of the drop-on-demand kind and, more specifically, to improved ink supply constructions for such devices.

BACKGROUND OF INVENTION

In drop-on-demand ink jet printers single drops are ejected from an orifice by on demand actuation of a transducer, most commonly either an electro mechanical transducer (as used in piezo-electric printers) or an electro-thermal transducer (as used in bubble jet printers). In both of these approaches, it is necessary to reliably contain the ink and refill the drop ejection region after an ink drop has been ejected through the orifice. Refill ink can be supplied from a reservoir integral with the print head (in "print/cartridge embodiments") or, via an umbilical conduit, from a remote reservoir. Usually, a combination of capillary ink feed and atmospheric pressure, transmitted hydraulically, is employed in refilling the drop ejection region. In some prior art systems, further means, e.g. positive pressure sources or gravitational forces acting via a hydrostatic head are used instead of, or to supplement, the usual approach. However, such further means are cumbersome, particularly in print/cartridge embodiments, where the desire is for compact insertable units. Thus, supplying refill ink via capillary action and transmitted atmospheric pressure is most attractive; U.S. Pat. Nos. 4,095,237 and 4,329,698 provide examples of drop-on-demand ink jet print/cartridges using this approach.

As described in U.S. Pat. Nos. 4,509,062 land 4,630,758, it is often desirable that the ink supply region be subject to a slight, relatively constant, negative pressure (or back pressure). Such back pressure prevents ink from drooling, or being easily shaken, from the orifices, but it should not be so large as to prevent adequate ink refill of the drop ejection zone. To accomplish a controlled back pressure the '062 patent suggests a bladder reservoir which exhibits a substantially constant spring force while collapsing. The '758 patent suggests filling the reservoir with a foam like material that exerts a controlled capillary back pressure. U.S. Pat. Nos. 3,967,286; 4,095,237 and 4,771,295 also point out the desirability of using a capillary foam material within ink reservoir to prevent introduction of air into the ink path to the print head.

However, there have been certain disadvantages to these prior art approaches. For example, as noted in U.S. Pat. No. 4,794,409, the resilient bladder and foam reservoir approaches have not utilized the reservoir storage volume efficiently (from the viewpoint of maximizing the percentage of the reservoir's interior volume that is available as printable ink). Also, it is noted that the back pressure is difficult to maintain constant with both prior art techniques and that the specially prepared, "cut and cleaned" foam of the '295 device adds significant cost.

SUMMARY OF INVENTION

Thus, one important object of the present invention is to provide, for drop-on-demand ink jet printing, improved ink reservoir construction which significantly reduce the above-noted problems of prior art devices. One highly useful advantage of the ink reservoirs of the present invention, is their improved efficiency as to maximizing the part of their volume that constitutes suppliable ink.

Another advantage of ink reservoirs of the present invention is that they contain foam-like structures having pore sizes that are much more uniform than those of conventional foam materials. Since the pressure required to extract ink from foam is inversely proportional to the pore size, a more uniform pore size leads to much more uniform release of ink. Conversely, when the pore size varies widely, some of the pores are so small that it is very difficult to extract the ink they contain, while other pores are so large that they release ink with very little pressure. These variations, which lead to poor utilization of the ink storage volume in the former case, and to "drooling" of ink from the printing mechanism in the latter case, are reduced significantly by the present invention.

Another advantage of preferred embodiments of the present invention is that its foam material is much more chemically inert than the prior art foam material. Prior art materials such as polyurethane foam swell when immersed in water or glycol. Furthermore, they tend to selectively leach penetrants, dye constituents, and other ink ingredients from the ink, so that ink formulations must be adjusted from the desired printing formulation, to compensate for leached ingredients. The more inert materials of the present invention significantly reduce these problems.

Another advantage of the reservoirs constructed according to the present invention is that its foam type materials are much more easily saturated with ink than previously used materials. In prior materials, high vacuum is used to urge the ink into the thick walled vesicles of the foam. The advantageous configuration of interconnected thin filaments of foam materials according to the present invention do not inhibit penetration of ink, making filling of a reservoir made from such materials a much more simple task in a manufacturing environment.

Another advantage of preferred embodiments of the present invention is that the foam materials utilized are hydrophilic, in contrast with previously used hydrophobic materials, which repel water based ink formulations and frustrate the reservoir filling process.

Another significant advantage of the present invention is its provision of a foam material which requires much less pretreatment (e.g. burning of cell walls and cleaning) prior to incorporation in the ink reservoir.

In one embodiment, the present invention constitutes an improved ink reservoir construction for a drop-on-demand ink jet printing with a print head components of the kind including drop ejection orifices, related drop ejection transducers and passage means for containing ink in drop ejection regions proximate the transducers. The ink reservoir comprises a housing defining an ink storage volume and has a vent opening and an ink outlet fluidly coupled to the print head passage means. A mass of predetermined foam-type material substantially fills a major portion of the housing and covers the ink outlet. The predetermined foam material is a three-dimensional network of very fine filaments that are interconnected so as to yield a large void volume comprised of relatively uniform size interstitial pores. In a preferred embodiment, the foam is innately reticulate so as to constitute a purely skeletal, network formed without membranes in the network intersticies and, in its uncompressed state, is substantially isotropic.

In a related aspect, the present invention constitutes a process for drop-on-demand ink jet printing comprising the steps of: (i) selectively ejecting ink drops from a drop ejection region(s) through a related orifice(s); (ii) feeding ink through a capillary feed passage(s) to the drop ejection region(s) to replace ejected ink drops; and (iii) supplying ink to said capillary passage(s) from a low bulk density foam structure comprising a mass of mutually connected, three-dimensionally branched webs. One specifically preferred foam material is an innately reticulate melamine-formaldehyde condensate foam.

BRIEF DESCRIPTION OF DRAWINGS

The subsequent description of preferred embodiments refers to the accompanying drawings wherein:

FIG. 1 is a perspective view of a preferred ink jet print/cartridge construction in accord with the present invention;

FIG. 2 is an exploded view of portions of the FIG. 1 print/cartridge;

FIG. 5 is a schematic view, partially in cross section showing another preferred ink jet printing system in accord with the present invention;

FIG. 6 is a cross-sectional view of another preferred print/cartridge construction in accord with the present invention;

FIG. 7 is a scanning electron micrograph of one preferred ink reservoir foam material in accord with the present invention; and FIG. 8 is a scanning electron micrograph at the same magnification as FIG. 7 showing a prior art ink reservoir foam material.

DETAILED DESCRIPTION OF PREFERRED EMBODIMENTS

Figure 3:
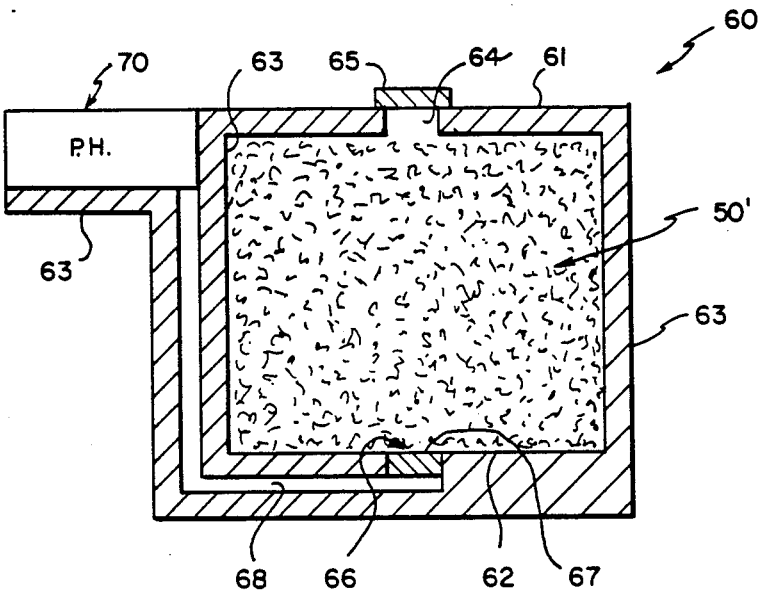
FIG. 3 is a schematic cross section of another preferred ink jet print/cartridge construction in accord with the present invention.

FIG. 1 illustrates one exemplary bubble jet print/cartridge embodiment incorporating the present invention. The print/cartridge 1 includes an ink reservoir housing comprised of side walls 2, bottom walls 3 and cap assembly 4. The cap assembly can comprise a closure and frame component 6 that is sized to interfit around the top ends of walls 2 of the reservoir and a fluid block component 10 that is constructed to interfit with the inner periphery of frame component 6.

As better shown in FIG. 2 the fluid block component 10 has an outlet passage 13 extending from its outer surface into the ink supply reservoir and an "H" shaped recess 12 formed in the outer surface and coupled to outlet 13. The intermediate portion of recess 12 provides for ink flow to the opposing parallel portions 12*a*, 12*b* of the recess.

Also shown in FIG. 2, a drop ejection chip 20 is mounted atop fluid block 10. Chip 20 comprises a dielectric substrate 21 supporting a plurality of resistive heater elements 22, selecting electrodes 23, reference electrodes 24 and connection terminals 25. The heater elements and electrodes can be overcoated with appropriate protective layers. The recess 12 is sized relative to the chip substrate 21 so that, when chip 20 is mounted on the fluid block component 10, the major portion of recess 12 is covered by the lower surface of substrate 21. However, a part of the opposing recess portions 12*a*, 12*b*, remain open to allow ink flow from the reservoir to the edges of the chip 20.

An ink barrier and manifold layer 30, e.g. a photo polymer, is formed on the top surfaces of the chip and block to provide an ink barrier fence 31 that surrounds the open recess portions 12*a*, 12*b* and the resistive heater elements 22 of the chip. A series of baffle walls 32 extend over the surface of chip 20, between recesses 12*a*, 12*b*, to separate the individual resistive heater elements 22.

An orifice plate 40 is attached to the barrier and manifold layer 30 and comprises a plurality of orifices 41 formed in a pattern conforming to the pattern of heater elements 22 on chip 20. The orifices 41 are aligned to be located between baffle walls 32 and directly over respective heater elements 22 so that ink bubble formation, caused by heating of a resistive element, will effect drop ejection of ink through its related orifice.

The assembled fluid block component 10 is mounted into frame 6, and electrical leads 8 and connector pads 9 are formed respectively for each of the terminal portions 25 on chip 20. When a print/cartridge is inserted into a printer, the connector pads 9 can be coupled to printer drive circuits to provide for selective firing of the heater elements 22. The print/cartridge fabrication is completed by securing the top cap assembly 4, with all its supported components just described, to reservoir housing 1 which contains a supply of ink contained in a shaped mass of foam material 50 constructed in accord with the teachings of the present invention. The characteristics of ink reservoir foam materials that are useful and preferred, in accord with the present invention, are described in detail subsequently; however, next several other ink jet printing system constructions in which such foam materials are useful will be described briefly.

Thus, referring to FIG. 3, another such print/cartridge 60 comprises a main housing with top, bottom an side walls 61, 62, 63 forming an ink supply reservoir. The top wall 61 comprises an air vent opening 64, with an ink leak closure membrane 65. The bottom wall 62 comprises an ink outlet 66, which can contain a filter member 67, and which supplies ink into the capillary feed passage 68 of the print/cartridge 60. As shown, the feed passage extends across the bottom and up one side of the main housing to a bubble jet print head component, denoted generally P.H.

Figure 4:
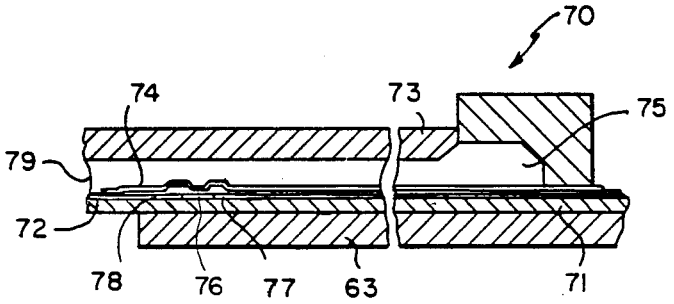
FIG. 4 is a cross sectional view of a print head component structure useful in the FIG. 3 embodiment.

FIG. 4 illustrates one form in which print head P.H. of FIG. 3 can be constructed. In FIG. 4 the edge shooter bubble jet print head 70 comprises, a base substrate 71 on which is coated a heat control layer 72. A grooved top plate 73 defines a plurality of ink supply channels leading from ink manifold reservoir 75, which is coupled to passage 68 of housing 60 (shown in FIG. 3). Located upstream from the orifices 79 and formed between the grooves of top plate 73 and substrate 71, are a plurality of selectively addressable electro thermal transducers. These transducers each comprise a discrete resistive heater portion 76, and a discrete address electrode 77. A common electrode 78 can be coupled to the edge of each heater element opposite its address electrode. Formed over both the electrodes and heater elements is a protective layer(s) 74.

FIG. 5 illustrates another ink jet print system in which the present invention is useful. In this embodiment an ink reservoir 80 is coupled by umbilical 88 to the manifold 75′ of a side shooter bubble jet print head 70'. In this embodiment print head components similar to the FIG. 4 embodiment are indicated by corresponding "primed" numerals. The primary difference in the FIG. 5 print head is that the top plate comprises separate components which cooperate to provide side ejection passages to orifices 79'. Upon activation current passes through heater 76' between the address and common electrodes 72', 78', and ink is heated to eject a drop through the related orifice of plate 79'. The remote ink reservoir 80 is mounted within the printer mainframe (not shown) and comprises a housing having top, bottom and side walls 81, 82, 83. The top wall comprises an air vent 84 having a liquid blocking membrane 85 and bottom wall 82 comprises an outlet passage 86 coupled to umbilical 88. In accord with the present invention a mass of predetermined foam material 50" is shaped to conform to the interior of the remote ink reservoir and feed ink into umbilical 88.

FIG. 6 illustrates a piezoelectric print cartridge 90, having a housing which is similar to the FIG. 3 device. Thus, a reservoir is defined by top, bottom and side walls 91, 92, 93 and has an air vent opening 94, closure 95 and ink outlet opening 96 and filter 97 like the FIG. 3 embodiment. In this embodiment, capillary passage 98 leads to a piezoelectric print head component comprising drop ejection regions 99, each containing an electrostrictive element. Upon selective activations of elements 99 ink drops can be ejected through corresponding orifices 100. Like the FIGS. 1, 3 and 5 embodiments the ink reservoir of the FIG. 6 embodiment, contains a shaped foam mass 50''' constructed, as will now be described in detail, in accord with the present invention.

FIG. 7 is a scanning electron micrograph of a material structure I have discovered to be uniquely advantageous for use in ink jet printer supply reservoirs. In general these remarkably improved ink reservoir structures can be described as constituting in their uncompressed condition, a substantially isotropic network of very fine filaments that are interconnected so as to yield a large void volume comprised of relatively uniform size interstitial pores. The preferred material shown in FIG. 7 is a foam that is innately reticulate so as to have no cell windows. That is, the foam is a purely skeletal, three dimensional, network formed without membranes in the network intersticies. In contrast to a mass of unconnected fibers, the three dimensionally interconnected skeletal filaments of materials according to the present invention, provide and maintain uniform interstices to improve ink storage and delivery. In contrast to previous foams that are reticulated by burning techniques, the materials of the present invention provide a significantly higher void volume, with no blocked, or partially blocked, intersticies and have no residual "burned cell wall" debris. This results in significant improvements as to the amount of ink that is storable in, and deliverable from given volumes of materials of the present invention.

In comparison to prior art ink reservoir foams (of which FIG. 8 is a "reticulated" polyurethane example), foam type materials according to the present invention (of which FIG. 7 is a thermoset melamine condensate example) exhibit a number of advantageous distinctions.

First, in regard to physical structure, materials of the present invention comprise a three dimensional network of very fine filaments, innately without cell walls. The filaments have a relatively large length to width ratio, e.g. in the order of about 10 to 1 or greater.

The innate skeletal nature of foam type masses of the present invention yields a low bulk density and large void volume because of the high percentage of their volume comprising interstitial voids. In these aspects, the materials can be characterized as having in their utilized condition within the ink reservoir (i.e. uncompressed or compressed condition):

(i) a void volume greater than about 95%, preferably greater than about 97% most preferably greater than about 99%; or (ii) a bulk density less than about 1.5 lbs./ft.$^3$, preferably less than about 1.0 lbs./ft.$^3$, most preferably less than about 0.7 lbs./ft.$^3$.

In regard to pore size, materials according to the present invention can be characterized as having a relatively uniform pore sizes, with a relatively small percentage of voids significantly smaller than the average pore size. More particularly the materials can be characterized as having::

(i) an average pore size in the range of about 25$\mu$ to 200$\mu$, preferably in the range of about 50$\mu$ to 175$\mu$, most preferably having a majority of the pores in the size range of about 140$\mu$ to 160$\mu$; and (ii) a pore size uniformity such that at least about 95% of the pores have a size larger than 0.67 times the average pore size, preferably at least about 97.5% of the pores have a size larger than 0.67 times the average pore size and most preferably at least about 99.5% of the pores have a size larger than 0.67 times the average pore size.

In a most preferred embodiment where the majority of the pores have a size in the range of about 140$\mu$ to 160$\mu$ it is most preferred that substantially no pores have a diameter less than about 100$\mu$ and that the largest pores have a diameter no greater than about 175 microns. Thus, a range of pore sizes no greater than about 75$\mu$ yields a highly preferred uniformity in the release of ink from the foam material and a more uniform back pressure.

In regard to composition of foam materials, it is preferred that such materials be relatively inert vis a vis the chemicals comprising stored inks and not swell nor leach ingredients from the inks.

One highly preferred group of material, with respect to their composition as well as other aspects described above, are the thermoset foam materials described in U.S. Pat. No. 4,540,717 comprising preferably more than 80% melamine-formaldehyde condensate and most preferably, unmodified thermoset melamine formaldehyde condensate.

This particularly preferred group of melamine-formaldehyde condensate foams comprise a plurality of mutually connected, three-dimensionally-branched webs (or filaments). As described in the '717 patent the foam structures desirably have:

1. a mean length to width (diameter) ratio in the order of about 10:1 or greater; and
2. a web or filament density in the order of about 1.10 grams/milliliter or greater Webs which are too short (i.e. in which the length to diameter ratio is too low) can decrease the large void volume characteristic preferred for maximizing ink storage.

As pointed out in the '717 patent, the mean length to width (diameter) ratio can be measured microscopically and determined by a statistical counting methods. In such procedure the web length is defined as the distance between the centers of two nodes, and the web width (diameter) is defined as the narrowest part of a web, in each case measured on a photomicrograph. The density of the webs is determined by the principle of Archimedes, after placing a foam mass in a suitable liquid, for example isopropanol, with which it becomes fully impregnated by virtue of its open cell character.

Melamine foams for use in ink reservoirs according to the invention may be melamine formaldehyde condensates, that in addition to melamine, contain up to 50, preferably up to 20, percent by weight of other compounds which form thermosetting resins, and in addition to formaldehyde contain other aldehydes, as co-condensed units. However, the use of a substantially unmodified melamine formaldehyde condensate is particularly preferred, because of its high inherent chemical inertness to ink constituents.

The particularly preferred melamine foams according to the invention exhibit an extremely low bulk density, which is very desirable for providing increased void volume for ink storage. When manufactured by the ulra-high-frequency irradiation method described in U.S. Pat. No. 4,450,717, such foams can exhibit a bulk density of as little as $1.6[g0.1^{-1}]$.

Melamine foams of the kind described above are manufactured by BASF Aktiengesellschaft, Federal Republic of Germany (BASF Corp., Chemical Div., Parsippany, N.J.), and sold under the tradename BASOTECT® by that company and under the tradename WILTEC® by Illbruck Schaumstofftechnik, Leverkusen, West Germany (Illbruck USA, Minneapolis, Minn.). These foams are commonly marketed for heat and sound insulation in buildings, vehicles and larger containers. Other known uses are as shock absorption packaging, bandages, cleaning materials and soil treatment.

I have discovered that the melamine formaldehyde condensate foams described above perform remarkably in solving the problems heretofore existent in prior art ink jet printing system reservoirs. This is so in part because their substantially isotropic network of very fine filamentary elements has substantially completely open cell walls of very uniform size (in comparison to prior art structures). This provides a superior pore structure and very high void volume for storing ink. Such structure allows more ink storage for a given reservoir volume and provides a more stable ink holding (and back pressure) characteristic than prior art foam structures used in ink reservoirs. While it is presently preferred to utilize these foam structures in a generally uncompressed state within the reservoirs, compression may be desired in particular applications to adjust structural interstitial spaces, while maintaining the useful or preferred characteristics discussed above.

The superior performance in ink jet reservoirs by foams of the present invention is illustrated by the following results of a test comparing operation of two otherwise identical print/cartridges, one using burned and cleaned polyurethane as described in U.S. Pat. No. 4,771,295 and as presently used commercially in ink jet print/cartridges and one using the commercially available, acoustic Wiltec® melamine based, open cell foam, as described above, in a substantially uncompressed state.

| | Melamine Foam | Reticulated Polyurethane Foam |
|---|---|---|
| Pen Weight w/o ink | 10.02 grams | 11.52 grams |
| Pen Weight w/ink | 21.19 grams | 21.10 grams |
| Amt. Ink "Stored" | 11.17 grams | 9.58 grams |
| Pen Weight Printed "dry" | 12.49 grams | 14.56 grams |
| Amt. Ink Printed | 8.70 grams | 6.54 grams |
| Volume of Ink Printed sp. gr. ink = 1.102) | 7.90 ml | 5.94 ml |
| Volume of Pen Body | 10.21 ml | 10.21 ml |
| % of Pen Volume Used | 77% | 58% |

Neither foam showed signs of premature starvation when printed continuously at 2 KHZ. All jets stopped printing abruptly for both materials.

In addition to its remarkable characteristics in volumetric supply efficiency and superior ink holding capability, the Wiltec® open cell melamine foam exhibited superior ink compatibility in comparison to reticulated polyurethane. This is believed to be due not only to the composition of the foam but to its innate reticulate constitution and thermosetting fabrication. Thus, prior art "reticulated" polyurethane foam such as shown in FIG. 8 has partially remaining cell walls and residue remaining from the reticulation burning process. The cell walls and debris have been found to absorb ink components, e.g. surfactant and dye. This renders print drying and density less desirable. However, foams of the present invention, with their fully open cell wall structure and dense skeletal filaments do not absorb important ink components to a degree that affects printing. The difference in absorption is observable by comparing the two foams with the same inks. The melamine based open cell foam indicates no ink pick up and the reticulated polyurethane exhibits a visible yellowish tint.

While the specific melamine based foams described above are particularly preferred for use in the reservoirs of ink jet print systems one skilled in the art will appreciate that other ink compatible foam structures comprised of three dimensionally networked fine filaments and exhibiting low bulk density and substantially completely open cells structure of similar size and uniformity will also be useful. As noted above, foam materials having the desired characteristics described above can be used within ink reservoirs in uncompressed or partially compressed states.

The invention has been described in detail with particular reference to certain preferred embodiments thereof, but it will be understood that variations and modifications can be effected within the spirit and scope of the invention.

I claim:

1. In a drop-on-demand, ink jet system of the kind having a print head component including orifices, drop ejection transducers and passage means for supplying ink to drop ejection regions proximate said transducers, an improved ink supply reservoir comprising:

(a) a housing defining an ink storage volume and having a vent opening and an ink outlet connected to said passage means;

(b) a mass of foam material occupying a major portion of said housing and covering said ink outlet, said foam comprising three dimensionally branched network of fine filaments interconnected so as to form a large void volume composed of uniform size interstitial pores.

2. The invention defined in claim 1 wherein said foam material is innately reticulate.

3. The invention defined in claim 1 wherein said foam material is a thermoset melamine condensate.

4. The invention defined in claim 1 wherein said foam material, in its utilized state within said housing, has a void volume greater than about 95% of its total volume.

5. The invention defined in claim 1 wherein said foam material, in its uncompressed state, has a bulk density of less than about 1.5 lbs./ft.$^3$.

6. The invention defined in claim 1 wherein said foam network is substantially isotropic in its uncompressed state.

7. The invention defined in claim 1 wherein said foam material, in its uncompressed state, has an average pore size in the range of about 50μ to 175μ.

8. The invention defined in claim 7 wherein the majority of said foam material pores have a size in the range of about 140μ to 160μ.

9. The invention defined in claim 8 wherein said foam material contains substantially no pores with a diameter less than about 100μ.

10. The invention defined in claim 1 wherein said foam material in its uncompressed state has a range in pore size diameters no greater than about 75μ.

11. The invention defined in claim 1 wherein the majority of said pores have a diameter in the range of about 140μ to 160μ and at least about 95% of the pores have a diameter larger than 0.67 times the average pore diameter.

12. The invention defined in claim 1 wherein said foam material filaments have a length to width ratio in the order of about 10 to 1 or greater.

13. The invention defined in claim 1 wherein said foam material contains no cell membranes between filaments.

14. The invention defined in claim 1 wherein said foam material is substantially chemically inert with respect to ink constituents.

15. The invention defined in claim 14 wherein said foam material contains substantially unmodified melamine formaldehyde condensate that has been thermoset.

16. In a drop-on-demand, ink jet print system of the kind having a print head and ink reservoir means in fluid communication with said print head, the improvement wherein said reservoir means comprises:

(a) a housing defining an ink storage volume and having an ink outlet connected to said print head;

(b) an innately reticulate foam structure substantially filling said housing, said foam structure comprising a plurality of fine, mutually connected, three-dimensionally branched filaments.

17. The invention defined in claim 16 wherein said filaments (webs) have a length/width ratio of about 10 to 1 or greater.

18. The invention defined in claim 16 wherein said foam comprises a melamine formaldehyde condensate.

19. The invention defined in claim 16 wherein said foam contains not less than 80% by weight of melamine formaldehyde as condensed units.

20. The invention defined in claim 19 wherein said filaments have a density greater than 1.10 g/cm$^3$.

21. The invention defined in claim 16 wherein said foam has a bulk density less than about 1.5 lbs./ft.$^3$.

22. A process for drop-on-demand ink jet printing comprising the steps of:

(a) selectively ejecting ink drops from drop ejection regions through related orifices;

(b) feeding ink through capillary feed passages to the drop ejection regions to replace ejected ink drops; and (c) supplying ink to said capillary passages from foam structure comprising a mass of fine, mutually connected, three-dimensionally branched filaments.

23. The invention defined in claim 22 wherein said foam material is innately reticulate.

24. The invention defined in claim 22 wherein said foam material is a thermoset melamine condensate.

25. The invention defined in claim 22 wherein said foam material, in its utilized state within said housing, has a void volume greater than about 95% of its total volume.

26. The invention defined in claim 22 wherein said foam material, in its uncompressed state, has a bulk density of less than about 1.5 lbs./ft.$^3$.

27. The invention defined in claim 22 wherein said foam material network is substantially isotropic in its uncompressed state.

28. The invention defined in claim 22 wherein said foam material, in its utilized state, has an average pore size in the range of about 50μ to 175μ.

29. The invention defined in claim 22 wherein the majority of said foam material pores have a size in the range of about 140μ to 160μ.

30. The invention defined in claim 22 wherein said foam material contains substantially no pores with a diameter less than about 100μ.

31. The invention defined in claim 22 wherein said foam material in its uncompressed state has a range in pore size diameters no greater than about 75μ.

32. The invention defined in claim 31 wherein the majority of said pores have a diameter in the range of about 140μ to 160μ and at least about 95% of the pores have a diameter larger than 0.67 times the average pore diameter.

33. The invention defined in claim 22 wherein said foam material filaments have a length to width ratio of about 10 to 1 or greater.

34. The invention defined in claim 22 wherein said foam material contains no cell membranes between filaments.

35. The invention defined in claim 22 wherein said foam material is substantially chemically inert with respect to ink constituents.

36. The invention defined in claim 35 wherein said foam material contains substantially unmodified melamine formaldehyde condensate that has been thermoset.

* * * * *